United States Patent [19]

Flockenhaus et al.

[11] 4,178,150

[45] Dec. 11, 1979

[54] PROCESS AND INSTALLATION FOR DRYING AND HEATING COAL

[75] Inventors: Claus Flockenhaus; Horst Fach, both of Essen; Günter Gabriel, Wattenscheid; Manfred Galow, Essen; Joachim Meckel, Heiligenhaus, all of Fed. Rep. of Germany

[73] Assignee: Bergwerksverband GmbH, Essen, Fed. Rep. of Germany

[21] Appl. No.: 863,795

[22] Filed: Dec. 23, 1977

[30] Foreign Application Priority Data

Dec. 29, 1976 [DE] Fed. Rep. of Germany ..... 2659335

[51] Int. Cl.[2] ..... F27B 15/00

[52] U.S. Cl. ..... 432/14; 432/16; 432/58

[58] Field of Search ..... 432/14, 15, 16, 17, 432/58

[56] References Cited

U.S. PATENT DOCUMENTS 3,904,549 9/1975 Barton et al. ..... 432/58

4,082,498 4/1978 Offergeld et al. ..... 432/58

*Primary Examiner*—John J. Camby

*Attorney, Agent, or Firm*—Michael J. Striker

[57] ABSTRACT

Coal is passed in a two-stage process through a drying and heating zone. The coal coming from the drying zone is separated from the heat carrier gas which is then passed into the atmosphere after going through an electrodust separator. The dried coal is delivered into the heating zone. The hot gas for the heating zone is furnished by a combustion device. The exhaust gas from the heating zone is separated from the heated coal which is recovered while the exhaust gas is passed back into the drying zone. Part of the hot combustion gas coming from the combustion chamber is branched off and passed into the exhaust gas coming out of the drying zone either directly behind the drying zone or behind the separator for separating the dried coal from the exhaust gas. The temperature of the exhaust gas from the drying zone is thus prevented from sinking below the sulfuric acid dewpoint or water vapor dewpoint which might result in corrosive damage to the apparatus, particularly to the electrodust separator.

9 Claims, 1 Drawing Figure

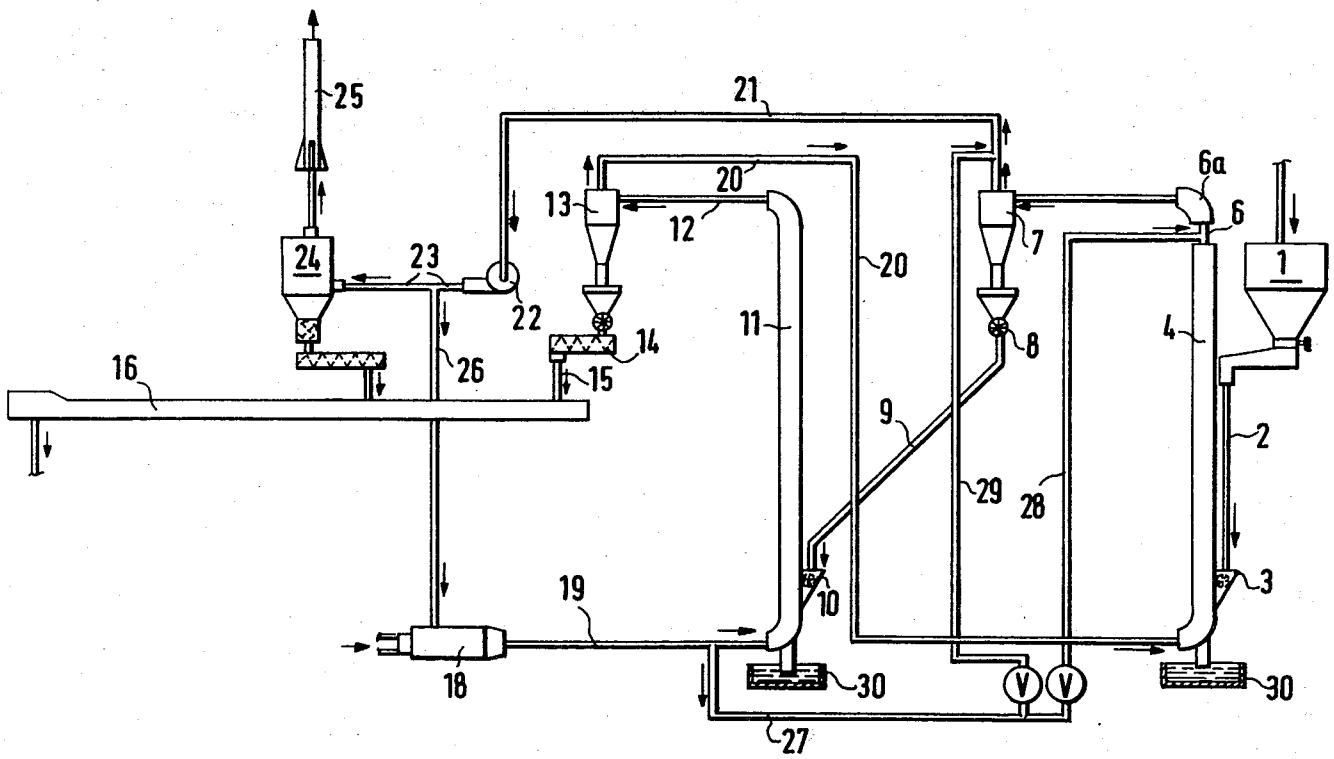
1
2
3
30
6a
6
4
28
7
8
29
9
20
10
30
27
21
20
11
12
14
15
13
19
22
26
18
23
25
24
16

PROCESS AND INSTALLATION FOR DRYING AND HEATING COAL

BACKGROUND OF THE INVENTION

The invention relates to a process and installation for heating coal to temperatures between about 100° and 500° C., preferably to about 200° C.

In this process the coal is subjected first to drying and then to heating. If this process is carried out in two or more stages a high degree of thermal efficiency is reached if the heat carrier gases are used first for heating and then for drying the coal, whereupon they may be at least partially passed into the atmosphere. The heat for drying the coal in this process is generally obtained from the relatively less hot heat carrier gases upon raising of the temperature to about 80° to 100° C. while the very hot heat carrier gases leaving the combustion chamber at about 600° C. result in a heating up of the coking coal to about 200° C.

The heat carrier gases which are exhausted from the drying stage usually undergo a cooling down of the temperature to a point where in case of gases having a substantial sulfur contents the sulfuric acid dewpoint is usually reached and passed. This is particularly critical where the water contents of the feed product changes quickly and thus suddenly rises above the starting value. The same is true for variations in the amount of throughput. Once the sulfuric acid dewpoint or even the water vapor dewpoint is reached, substantial difficulties for the various parts of the installation may ensue, for instance for the dust precipitator, the blower, the ducts, the measuring and control devices, etc., and this both as to their function and as to the possibility of corrosion.

The heating of coking coal by means of hot gases obtained from a combustion chamber to temperatures above 150° in two stages is known, the first stage serving as the drying zone and the second stage as the heating zone. The exhaust gases of the heating stage in this case are then used for the drying stage. One has also provided an exhaust gas duct between the heater and dryer which leads into the exhaust coming from the drying stage at a place immediately before the dust precipitator. This arrangement was intended to avoid the corrosion of the fine dust precipitator. It has, however, the disadvantage that all parts of the installation prior to the precipitator such as ducts, blowers, cyclone separators, elbow bends leading to the cyclones, recycling ducts for the hot vapors are still subject to corrosion. If the gas from the heater stage obtained from the cyclone separator were passed into the exhaust gas prior also to the blower, problems would occur because of excessive gas volumes in view of the low enthalpy. The blower would have to handle larger amounts and the gas ducts would have to be designed to excessively large dimensions.

It is therefore an object of the present invention to avoid these shortcomings of prior art devices and to prevent damage, in particular corrosion, to the parts through which the exhaust gas from the drying stage passes, in particular the fine dust precipitator.

SUMMARY OF THE INVENTION

According to the invention provision is made in the kind of device above-described to pass part of the hot heat carrier gases coming from the combustion chamber into the exhaust duct directly behind the drying oven.

Since, as stated, the gases from the combustion chamber usually have a temperature of 600° C., comparatively small amounts of these gases are necessary to accomplish the desired increase of the temperature of the exhaust gases coming from the drying zone. Thus, major changes in the installation and process are not necessary.

It has in particular been found that those parts of the apparatus which are situated behind the drying oven, such as the elbow bend, the cyclone separators, and particularly the dust precipitator are exposed to a higher degree of corrosion than the drying oven itself where surprisingly only comparatively low corrosion affected the wall members.

To obtain a reasonable degree of protection for all parts of the apparatus following the drying zone, it is preferred to pass the hot carrier gas, for instance, prior to or directly into the elbow bend preceding the first cyclone separator. However, if the cyclones and the duct associated therewith are made of non-corrosive materials or are not subject to corrosion for other reasons, it is possible also to pass the hot heat carrier gas into the exhaust gas behind the cyclone separator since it is the electric dust precipitator which is most jeopardized by the $SO_2/SO_3$-containing vapors.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The drawing shows in a schematic manner an installation for the operation of the process of the invention.

DETAILS OF THE INVENTION AND PREFERRED EMBODIMENT

The wet coking coal which is received from the supply bin 1 is introduced via the duct 2 and the bucket wheel valve 3 into the lower end and passed through the drying oven 4 and is then blown through the exhaust duct 6 and elbow bend **6*a* into the dryer cyclone 7**.

In this cyclone the dry coal is separated from the exhaust gas and is then passed via an inlet centrifuge 8, a duct 9 and a bucket wheel valve 10 into the flow-through heater 11. It passes out of the heater at the top through the duct 12 and then flows into the second cyclone 13 where it is separated from the exhaust gas of the heater. The coal then is passed through the mixing screw 14 and recovered by way of a duct 15 and a conveyor belt 16.

At the bottom end of both the dryer 4 and the heater 11 a water seal 30 is provided.

The operation of the process and apparatus is as follows:

Hot combustion air is obtained from a combustion chamber 18 which is provided with air by means of blowers. The combustion air is mixed with the feedback vapors from the duct 26 branching off the outer end of the exhaust line from the drying chamber. It is thus cooled and passed as heat carrier gas through duct 19 into the bottom end of the flow-through heating chamber 11. The heat carrier gas is then discharged together with the heated coal via the duct 12 into the separator cyclone 13. There the heat carrier gas is separated and passed out at the top of the cyclone and into the duct 20. It then enters the flow-through dryer 4.

From the dryer 4 the heat carrier gas escapes at the top together with the dried coal through the exhaust duct 6 and the elbow bend 6*a*. The exhaust gas is separated from the coal in the separator 7 and is passed out from the cyclone through duct 21 as a high dust contents gas. The flue gas blower 22 carries the gas further through duct 23 into the electric dust separator from which the gas then is discharged into the smokestack 25.

As has been indicated part of the high dust contents exhaust gas is recycled as feedback vapors from the duct 23 via the duct 26 into the combustion chamber 18 where it is mixed with the hot combustion gases to form a hot heat carrier gas of a temperature of about 600° C.

To accomplish, as indicated, that the temperature in the blower 22 and in the fine dust separator 24 does not sink below the dewpoint, a portion of the hot combustion gas is passed through ducts 19, 27 and 28 into the exhaust gas 6.

The normal temperature in the exhaust duct 6 would otherwise be about 140° C. while, by means of the introduction of the hot combustion gases this temperature is increased to about 200° C., at the most to about 250° C.

It is, however, also possible to introduce a part of the hot heat carrier gases from the duct 27 through another branch 29 at a later place into the exhaust gas 21, the point of introduction being behind the cyclone 7 for separating the dried coal from the exhaust gas. In this manner it will be possible to raise the temperature in the blower 22, the ducts 21, 23 and the dust separator 24 above the sulfuric acid dewpoint which is about 175° C.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for subjecting coal to a drying and subsequent heating step, said process comprising passing the feed coal through a flow-through drying zone while in contact with a heat carrier gas, then separating the coal from the exhaust gas and discharging the latter into the atmosphere, passing the dried coal thereupon into and through a flow-through heating zone where the coal is heated to a temperature in excess of 150° C. while in contact with a heat carrier gas, separating the hot coal from the exhaust gas of the heating zone recovering the coal while passing the separated exhaust gas from the heating zone into said drying zone, a portion of the hot gas generated in a combustion zone being branched off to be passed into the exhaust gas from the drying zone at the place where the said exhaust gas leaves said drying zone or at the place where said exhaust gas is subsequently separated from the dried coal or being passed into the exhaust gas from the drying zone at both of these places so as to prevent the temperature of the exhaust gas from sinking to or below the sulfuric acid or water vapor dewpoint.

2. The process of claim 1 wherein the exhaust gas separated from the dried coal in said drying zone is passed through an electric dust precipitator prior to being discharged into the atmosphere.

3. The process of claim 2 wherein part of the hot vapors derived from the exhaust gas of the drying zone prior to their entry into the dust precipitator are recycled into the hot gases generated in said combustion zone.

4. The process of claim 1 wherein the coal is subjected in the drying zone to a temperature of about 80° to 100° C. and is heated in the heating zone to a temperature of at least about 200° C. and wherein the hot gases leaving the combustion zone have a temperature of about 600° C.

5. An installation for subjecting coal to a drying and subsequent heating step, the said installation comprising a flow-through drying oven;

means for supplying fresh coal to said drying oven;

means for passing a heat carrier gas into said drying oven for contact with said coal;

first separator means for separating the dried coal from the exhaust gas of said drying zone;

a flow-through heating oven;

means for passing the dry coal from said first separator means into said heating oven for heating it to a temperature in excess of 150° C.;

duct means for passing the exhaust gas from said first separator into the atmosphere;

a combustion chamber for generating a hot heat carrier gas;

duct means for passing said hot carrier gas into said heating oven for contact with said dried coal;

second separator means for separating the heated coal from the exhaust gas of said heating oven;

means for recovering the coal separated from the latter exhaust gas;

a duct for passing the exhaust gas from the heating oven into the drying oven to provide the said heat carrier gas for contact with said fresh coal, and at least one branch duct provided on said duct from said combustion chamber to said heating oven leading into the exhaust gas from said drying oven so as to prevent the temperature of said exhaust gas of the drying oven to sink to or below the sulfuric acid or water vapor dewpoint.

6. The installation of claim 5 wherein the said branch duct for the combustion gas leads into the exhaust duct from the drying oven shortly behind the exit of the exhaust gas from the drying oven.

7. The installation of claim 5 wherein the branch duct for the combustion gas leads into the exhaust gas from the drying oven at a point behind the said first separator means.

8. The installation of claim 5 wherein the branch duct for the combustion gas is further branched so as to have one branch leading into the exhaust gas from the drying oven shortly behind the exit of the exhaust gas from the drying oven and having a second branch leading into the said exhaust gas behind the said first separator means.

9. An installation according to claim 5 which includes an electric dust precipitator in said exhaust duct from the drying oven to purify the exhaust gas before passing it into the atmosphere.

* * * * *

UNITED STATES PATENT AND TRADEMARK OFFICE

CERTIFICATE OF CORRECTION

PATENT NO. : 4,178,150

DATED : December 11, 1979

INVENTOR(S) : Claus Flockenhaus et al.

It is certified that error appears in the above-identified patent and that said Letters Patent are hereby corrected as shown below:

In the heading, the assignees should read

-- Bergwerksverband GmbH and Didier Engineering GmbH, both of Essen, Federal Republic of Germany --.

Signed and Sealed this

*Eleventh* Day of *May 1982*

[SEAL]

*Attest:*

GERALD J. MOSSINGHOFF

*Attesting Officer*

*Commissioner of Patents and Trademarks*